US009016245B2

(12) United States Patent
Van Farowe et al.

(10) Patent No.: US 9,016,245 B2
(45) Date of Patent: Apr. 28, 2015

(54) ENGINE FLUID COOLING ASSEMBLY

(71) Applicant: Caterpillar Inc., Peoria, IL (US)

(72) Inventors: Jason Van Farowe, Brimfield, IL (US); Vasanthakumar Ganesan, Dunlap, IL (US); Shaun Fogle, Peoria, IL (US); Peitong Jin, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 144 days.

(21) Appl. No.: 13/731,690

(22) Filed: Dec. 31, 2012

(65) Prior Publication Data

US 2014/0182524 A1 Jul. 3, 2014

(51) Int. Cl.
*F01P 11/08* (2006.01)
*F01M 1/00* (2006.01)

(52) U.S. Cl.
CPC . *F01P 11/08* (2013.01); *F01M 1/00* (2013.01)

(58) Field of Classification Search
CPC ..... F01P 11/08
USPC ..... 123/41.33, 41.51, 41.42, 41.43, 196 AB; 165/51, 145, 167
See application file for complete search history.

(56) References Cited

U.S. PATENT DOCUMENTS

| | | | | | |
|---|---|---|---|---|---|
| 4,303,052 | A * | 12/1981 | Manfredo et al. | 123/563 |
| 4,424,778 | A | 1/1984 | Yoshida | |
| 4,620,509 | A | 11/1986 | Crofts | |
| 5,035,207 | A * | 7/1991 | Sakurai et al. | 123/41.1 |
| 5,113,930 | A * | 5/1992 | le Gauyer | 165/78 |
| 5,606,937 | A * | 3/1997 | Calhoun | 123/41.28 |
| 6,418,886 | B1 | 7/2002 | Haimerl et al. | |
| 6,488,003 | B2 | 12/2002 | Karlsson | |
| 6,536,381 | B2 | 3/2003 | Langervik | |
| 6,901,903 | B2 | 6/2005 | Nakajima et al. | |
| 7,347,248 | B2 * | 3/2008 | Kolb et al. | 165/42 |
| 7,377,350 | B2 * | 5/2008 | Gokan et al. | 180/229 |
| 7,717,070 | B2 | 5/2010 | Kanig et al. | |
| 7,748,437 | B2 * | 7/2010 | Rohellec | 165/144 |
| 7,810,457 | B2 | 10/2010 | Blassnitz et al. | |
| 8,104,581 | B2 | 1/2012 | Gendermann | |
| 8,593,812 | B2 * | 11/2013 | Morino et al. | 361/707 |
| 2004/0173343 | A1 * | 9/2004 | Starr | 165/168 |

* cited by examiner

*Primary Examiner* — Lindsay Low
*Assistant Examiner* — Grant Moubry
(74) *Attorney, Agent, or Firm* — BakerHostetler

(57) ABSTRACT

A baffle for engine fluid cooling includes a fluid guide having a pair of side walls, a bottom wall, and a coolant fluid inlet. A channel receives a pair of heat exchangers such that one may be positioned proximate to or above a part of the bottom wall and the other may be positioned proximate to or above another part of the bottom wall. Some coolant entering the guide flows into the first heat exchanger and some coolant is passed under the first heat exchanger and subsequently into the second heat exchanger.

13 Claims, 9 Drawing Sheets

ENGINE FLUID COOLING ASSEMBLY

TECHNICAL FIELD

The present disclosure is directed to methods, apparatuses and systems for distributing coolant fluid (such as, for example, a water/glycol mixture or air) to two or more engine fluid (such as, for example, motor oil) heat exchangers

BACKGROUND

Engines, including diesel engines, gasoline engines, and gaseous fuel-powered engines are used to generate a mechanical, hydraulic, or electrical power output. In order to accomplish this power generation, an engine typically combusts a fuel/air mixture. With the purpose to ensure optimum combustion of the fuel/air mixture and to protect components of the engine from damaging extremes, the temperature of the engine and air drawn into the engine for combustion must be tightly controlled. The combustion process typically generates large amounts of heat and, in order to ensure proper and efficient operation of the engine, a cooling system is required to cool fluids directed into or out of the engine, such as, for example, coolant fluid and engine oil. A typical cooling system may have one or more heat exchangers designed to cool the coolant fluid by dissipating heat from the coolant into the atmosphere, and an oil cooler designed to cool the oil by transferring heat from the oil to the coolant fluid.

To accomplish the desired operational temperature control, an internal combustion engine is generally fluidly connected to one or more different liquid-to-air and/or air-to-air heat exchangers to cool both liquids and gases circulated throughout the engine. These heat exchangers are often located close together and/or close to the engine to maximize space efficiency. An engine driven fan or pump may be disposed either in front of the engine/exchanger package to blow air across the exchangers and the engine, or between the exchangers and engine to suck air past the exchangers and blow air past the engine, the airflow removing heat from the heat exchangers and the engine. In other arrangements cooling fluids from the environment, for example water from a marine environment, can be directed through the engine/exchanger package to remove heat therefrom.

One way to ensure proper engine and engine oil temperature is to include multiple heat exchangers in the cooling system. An exemplary heat exchanger arrangement is disclosed in U.S. Pat. No. 6,418,886 to Haimerl et al. In Haimerl, a V-configured internal combustion engine includes a coolant system with multiple heat exchangers. The Haimerl cooling system includes a coolant pump with a coolant inflow line that first directs coolant through a series of heat exchangers or "cooling jackets" disposed externally and to the sides of each of the engine's cylinder banks. The coolant is then directed through the cylinder heads and then through another series of heat exchangers disposed internally, or within the "V", and along the sides of the cylinder banks. The coolant is then guided, upon exiting the internal heat exchangers, back to the coolant pump.

As can be seen from the cooling system in Haimerl, when coolant is directed through a heat exchangers connected in series, the arrangement is not necessarily configured to provide uniform cooling among the tandemly disposed coolers. Specifically, there is at least one potential issue with series-type cooler configurations such as the one in Haimerl, in which coolant fluid (such as, for example, air) is provided at one end of the coolant flow path and passes past each heat exchanger in series as they are disposed within the coolant flow path. In such a configuration the coolant may be warmed by the first heat exchanger prior to exposure to the second heat exchanger along the coolant flow path; and, thus, the efficiently of the second heat exchanger (and any subsequent heat exchangers in the series) may be degraded due to the increased coolant temperature.

SUMMARY

A first aspect of the current disclosure provides a baffle for engine fluid cooling that may include a fluid coolant guide having a pair of side walls, a bottom wall, a coolant fluid inlet end and a coolant fluid outlet end; where the bottom wall may include a first portion with a first elevation extending from the fluid inlet end, a second portion with a second elevation distal from the fluid inlet end and a transition portion between the first and second portions; where the first elevation may be lower than the second elevation, and the transition portion may provide a transition from the first elevation to the second elevation; and where the side walls and bottom wall may provide, at least in part, a channel adapted to receive at least a first engine fluid cooling heat exchanger and a second engine fluid cooling heat exchanger therein so that the first heat exchanger may be positioned proximate to or above at least a part of the first portion of the bottom wall and so that the second heat exchanger may be positioned proximate to or above at least a part of the second portion of the bottom wall. With such a baffle, a first portion of fluid coolant entering the inlet end of the fluid coolant guide may be passed into the first heat exchanger and a second portion of the fluid coolant entering the inlet end of the fluid cooling guide may be passed under the first heat exchanger; and, subsequently, the second portion of the fluid coolant may be passed into the second heat exchanger after the second portion of the fluid coolant passes under the first heat exchanger.

In a more detailed embodiment of the first aspect, at least one of the side walls may include at least one coolant fluid outlet opening positioned between the first and second portions of the bottom wall, so that at least part of the first portion of the fluid coolant may exit through such outlet opening. In a more detailed embodiment, each of the side walls may include a plurality coolant fluid outlet openings positioned between the first and second portions of the bottom wall.

In a more detailed embodiment of the first aspect, the channel may be adapted to receive at least the first and the second heat exchangers therein so that the entire first heat exchanger may be positioned above the first portion of the bottom wall and so that the entire second heat exchanger may be positioned above the second portion of the bottom wall. Alternatively, or in addition, the transition portion of the bottom wall may include a ramp extending from the first portion to the second portion of the bottom wall. Alternately, or in addition, the coolant fluid inlet end and the coolant fluid outlet end may be open ends.

In a second aspect of the disclosure, an engine-fluid cooling assembly for an engine may include a fluid coolant guide that has a pair of side walls, a bottom wall, a coolant fluid inlet end and a coolant fluid outlet end. The bottom wall of the fluid coolant guide may have a first portion with a first elevation extending from the coolant fluid inlet end, a second portion with a second elevation distal from the coolant fluid inlet end and a transition portion between the first and second portions; and, further, the engine-fluid cooling assembly may further include a first engine-fluid cooling heat exchanger and a second engine-fluid cooling heat exchanger positioned within a fluid coolant channel formed by the side walls and bottom wall of the fluid coolant guide, where the first heat exchanger is positioned proximate to or above at least a part of the first portion of the bottom wall, the second heat exchanger is positioned proximate to or above at least a part of the second portion of the bottom wall, and the first and second heat exchangers include engine fluid flow paths routed therethrough. In a more detailed embodiment, the engine-fluid cooling assembly may further include a cover mounted to the side walls of the fluid coolant guide and disposed over the fluid coolant channel, where the first and second heat exchangers are mounted to the cover. In a more detailed embodiment, the cover may include engine-fluid flow paths respectively in fluid communication with the engine fluid flow paths of the first and second heat exchangers.

In a more detailed embodiment of the second aspect, the first portion of the bottom wall of the fluid coolant guide extends along the length of the first heat exchanger and the second portion of the bottom wall of the fluid coolant guide extends along the length of the second heat exchanger. Alternatively, or in addition, the transition portion of the bottom wall of the fluid coolant guide may include a ramp extending from the first portion to the second portion of the bottom wall of the fluid coolant guide. Alternatively, or in addition, at least one of the side walls of the fluid coolant guide may include at least one coolant fluid outlet opening positioned between the first and second portions of the bottom wall of the fluid coolant guide.

In a more detailed embodiment of the second aspect, the engine fluid cooling assembly may be adapted to cool motor oil and the first coolant fluid inlet end of the fluid coolant guide may be adapted to be supplied with coolant fluid in the form of a water/glycol mixture.

In a third aspect of the current disclosure a method is provided for distributing coolant fluid to at least a pair of first and second engine fluid cooling heat exchangers arranged in series in an engine fluid cooling assembly, where the first heat exchanger is positioned approximate to a fluid coolant inlet of the motor engine fluid cooling assembly and the second heat exchanger is positioned distal from the fluid coolant inlet. The method may include steps of passing a first portion of fluid coolant entering the fluid cooling assembly into the first heat exchanger and a second portion of the fluid coolant entering the fluid cooling assembly around the first heat exchanger; and passing the second portion of the fluid coolant into the second heat exchanger after the second portion of the fluid coolant passes around the first heat exchanger. In a more detailed embodiment, the step of passing the second portion of the fluid coolant entering the fluid cooling assembly around the first heat exchanger may involve a step of passing the second portion of the fluid coolant entering the fluid cooling assembly under the first heat exchanger; and the step of passing the second portion of the fluid coolant into the second heat exchanger may involve a step of passing the second portion of the fluid coolant up into the second heat exchanger. In a further detailed embodiment, the method may further include a step of exiting the first portion of the fluid coolant through outlet openings located between the first and second heat exchangers.

In a further detailed embodiment of the third aspect each of the passing steps may be performed, at least in part, by a baffle having a larger cross-sectional area under the first heat exchanger than under the second heat exchanger, and having an upwardly directed ramp extending between the first and second heat exchangers. Alternatively or in addition, each of the first and second portions of the fluid coolant individually may amount to less than 100% of the total fluid coolant entering the fluid coolant inlet.

DETAILED DESCRIPTION

Figure 1:
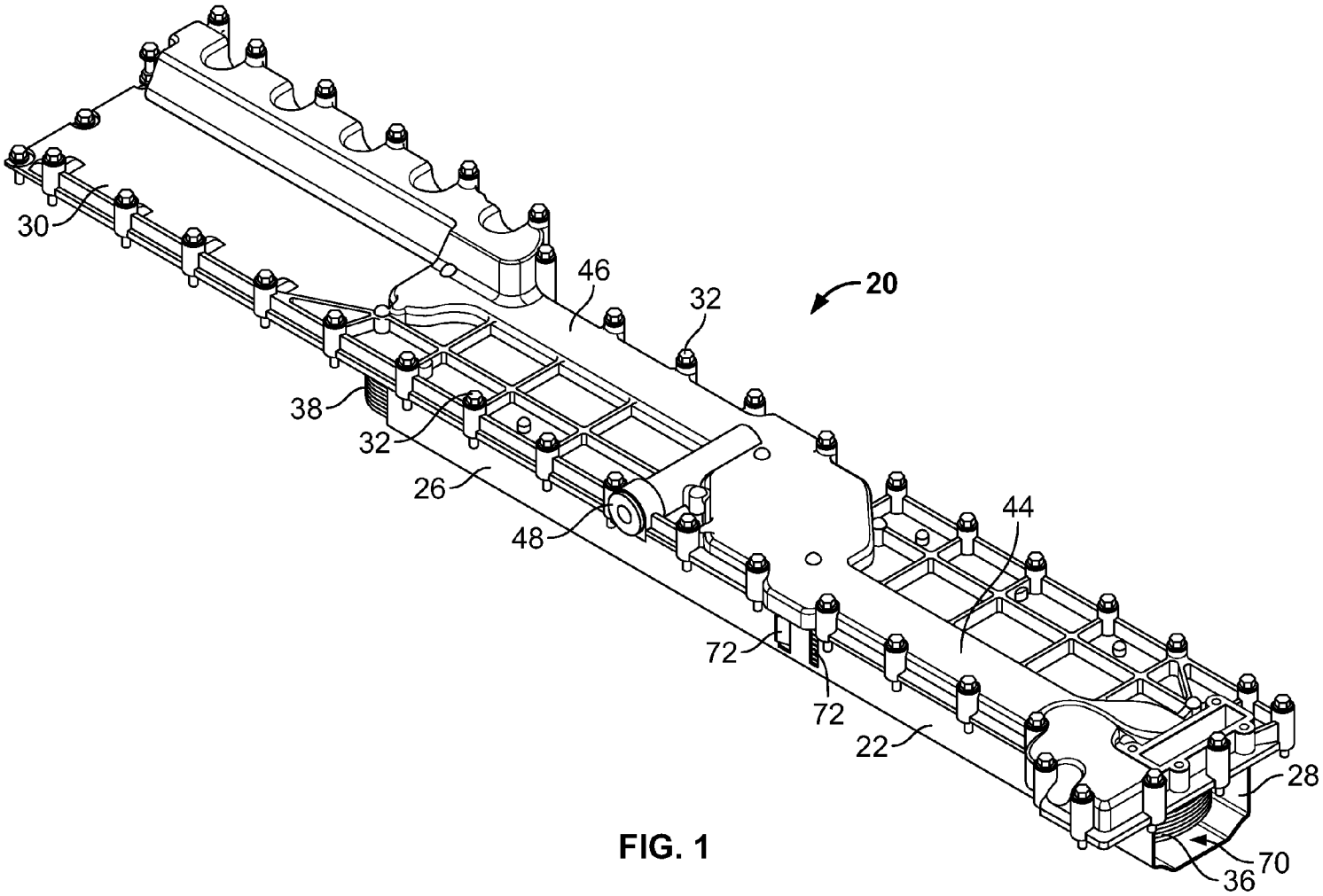
FIG. 1 is a perspective view of an embodiment of engine-fluid cooling assembly according to the current disclosure.
Figure 2:
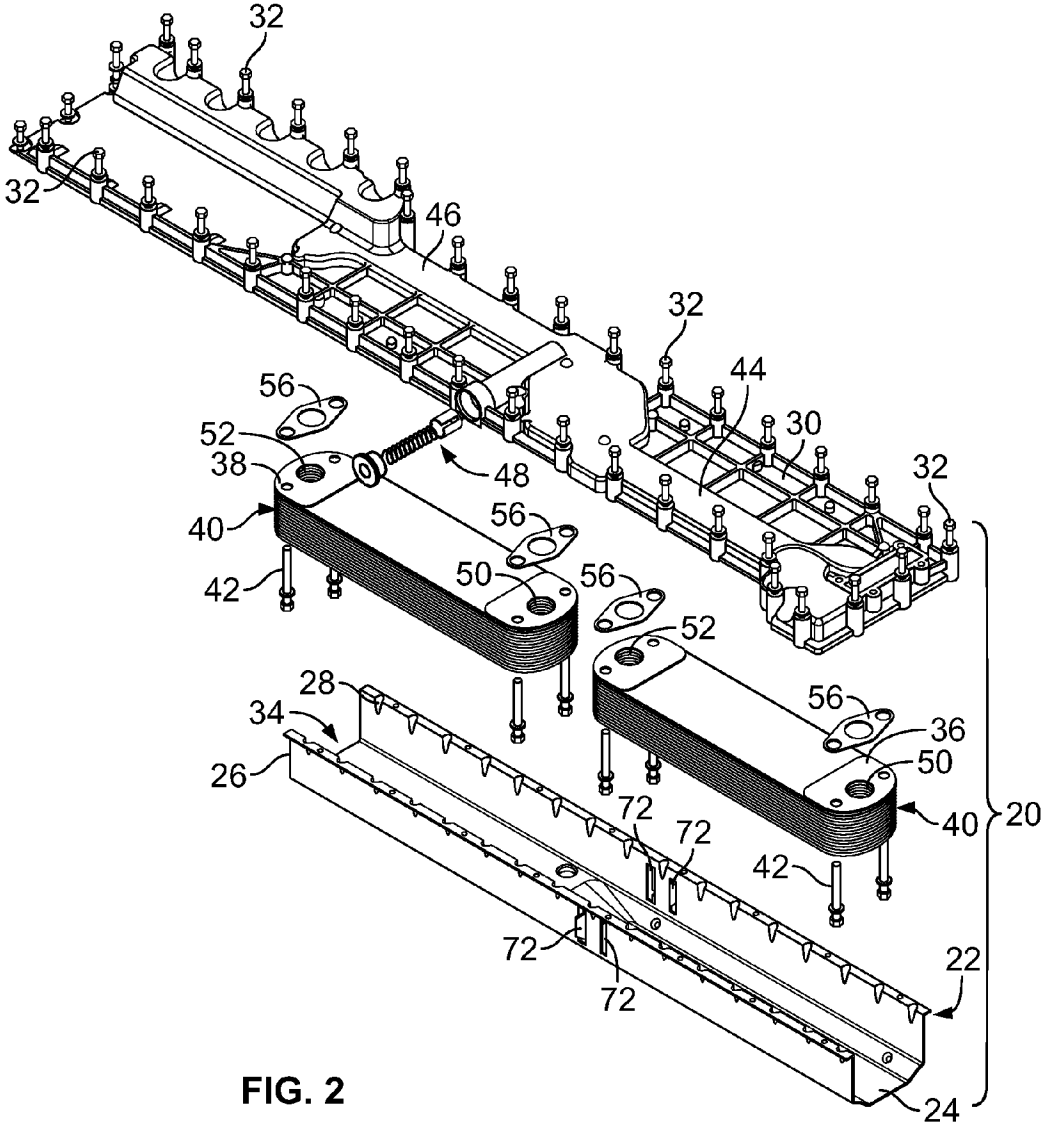
FIG. 2 is a perspective, exploded view of the embodiment of FIG. 1.

The present disclosure provides a heat exchanger configuration having at least two heat exchangers aligned in series along a coolant flow path. In an exemplary embodiment, the heat exchangers may be oil cooling heat exchangers disposed between the banks of a V-type engine. The current disclosure recognizes a potential problem with series-type oil cooler configurations in which coolant fluid (such as, for example, engine coolant) is provided at one end of the coolant flow path and passes past each heat exchanger in series as they are disposed within the coolant flow path. In such a configuration the coolant having an initial temperature may adsorb thermal energy from the first heat exchanger prior to exposure to the second heat exchanger along the coolant flow path; and, thus, an efficiently efficiency of the second heat exchanger (and any subsequent heat exchangers in the series) may be degraded due to the increased coolant temperature of coolant flowing thereover as compared to a heat exchanging efficiency of the first heat exchanger which received the coolant at the lower initial temperature.

The present disclosure provides a potential solution to this problem by specifically configuring a coolant guide, or baffle, to direct coolant flow over the two heat exchangers in a way that a substantial portion the coolant that flows over the first heat exchanger does not substantially flow over the second heat exchanger, and a substantial portion of the coolant entering the coolant guide is directed around the first heat exchanger to the second heat exchanger so that substantially unheated coolant flows to the second heat exchanger. Thereby, each heat exchanger maximizes its respective efficiency, which, for example, may allow for smaller overall heat exchangers to be utilized for a given application.

Generally, such a coolant guide, or baffle, may include a trough or depression proximate the first heat exchanger in the coolant path and a ramp positioned substantially between the first and second heat exchangers. The trough/depression may be deep enough under the first heat exchanger so that a first portion of coolant entering the inlet end of the coolant guide may flow through the heat exchanger and a second portion of the coolant entering the coolant guide may flow through the trough/depression and around the first heat exchanger. The area beneath the second heat exchanger is shallower than the area beneath the first heat exchanger (e.g., substantially no trough or depression exists in this area) so that the ramp connecting the two sections may direct coolant flowing through the trough/depression up into the second heat exchanger. Consequently, the second portion of the coolant flow may flow through the trough/depression up the ramp and into the second heat exchanger while the first part of coolant flow may flow through the first heat exchanger and may be discharged from the coolant guide before reaching the second heat exchanger. In essence, a somewhat "parallel" coolant flow may be achieved in a setup having a substantially series type heat exchanger configuration. Therefore, efficiency of the two heat exchangers may be increased. Aspects of this general configuration will be described in detail below with respect to the figures.

As shown in FIGS. 1-6, a first embodiment of an oil cooler assembly 20 according to the current disclosure may include a coolant guide 22 having a bottom wall 24 and a pair of side walls 26 and 28. A cover 30 may be adapted to be mounted over the coolant guide 22 and secured by a plurality of first fasteners 32. Mounted to the underside of the cover 30 for extending into the coolant flow path channel 34 provided by the coolant guide 22 may be a first oil heat exchanger 36 and a second oil heat exchanger 38. Each of the oil heat exchangers 36, 38 may respectively include an flow path for oil extending therein, having an outlet port 50 and an inlet port 52; and may further include a plurality of fins 40 providing increased surface area over which the coolant flowing in the coolant flow path 34 may contact and exchange heat.

The heat exchangers 36 and 38 may be mounted to the underside of the cover 30 by a plurality of second fasteners 42. The cover 30 may include an inlet oil passage 46 in fluid communication with the inlet ports 52 of the two heat exchangers 36, 38 and an outlet oil passage 44 in fluid communication with the outlet ports 50 of the two heat exchangers 36, 38. The cover 30 may also include a bypass valve 48 of ordinary configuration allowing the oil to bypass the heat exchangers 36, 38 when the bypass valve 48 is activated. Gaskets 56 may be provided between the inlet and outlet ports 52 and 50 of the respective heat exchangers 36, 38 in the outlet and inlet ports 50, 52 of the cover 30.

Figure 3:
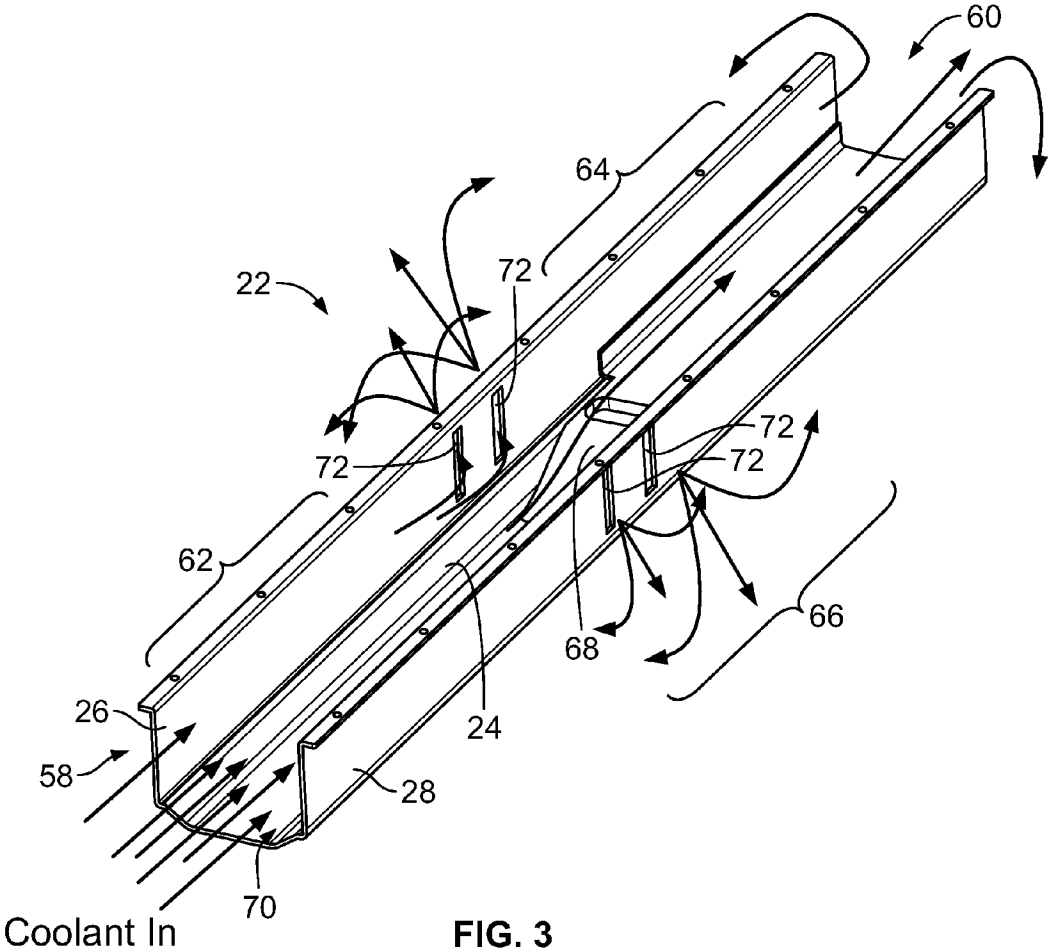
FIG. 3 is a perspective view of a coolant guide component of the embodiment of FIG. 1.
Figure 4:
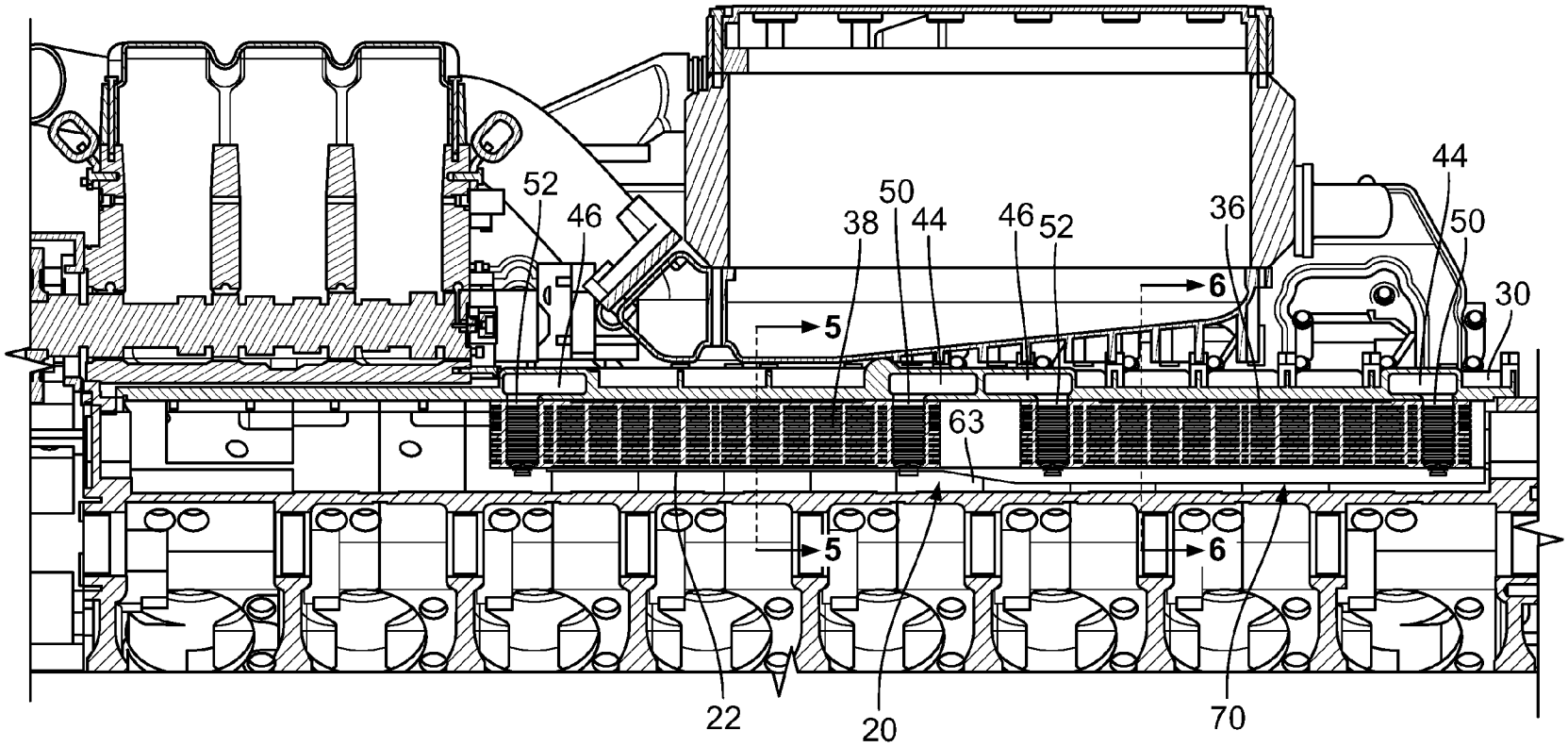
FIG. 4 is a cross-sectional view of the embodiment of FIG. 1 as installed in a V-type engine.
Figure 5:
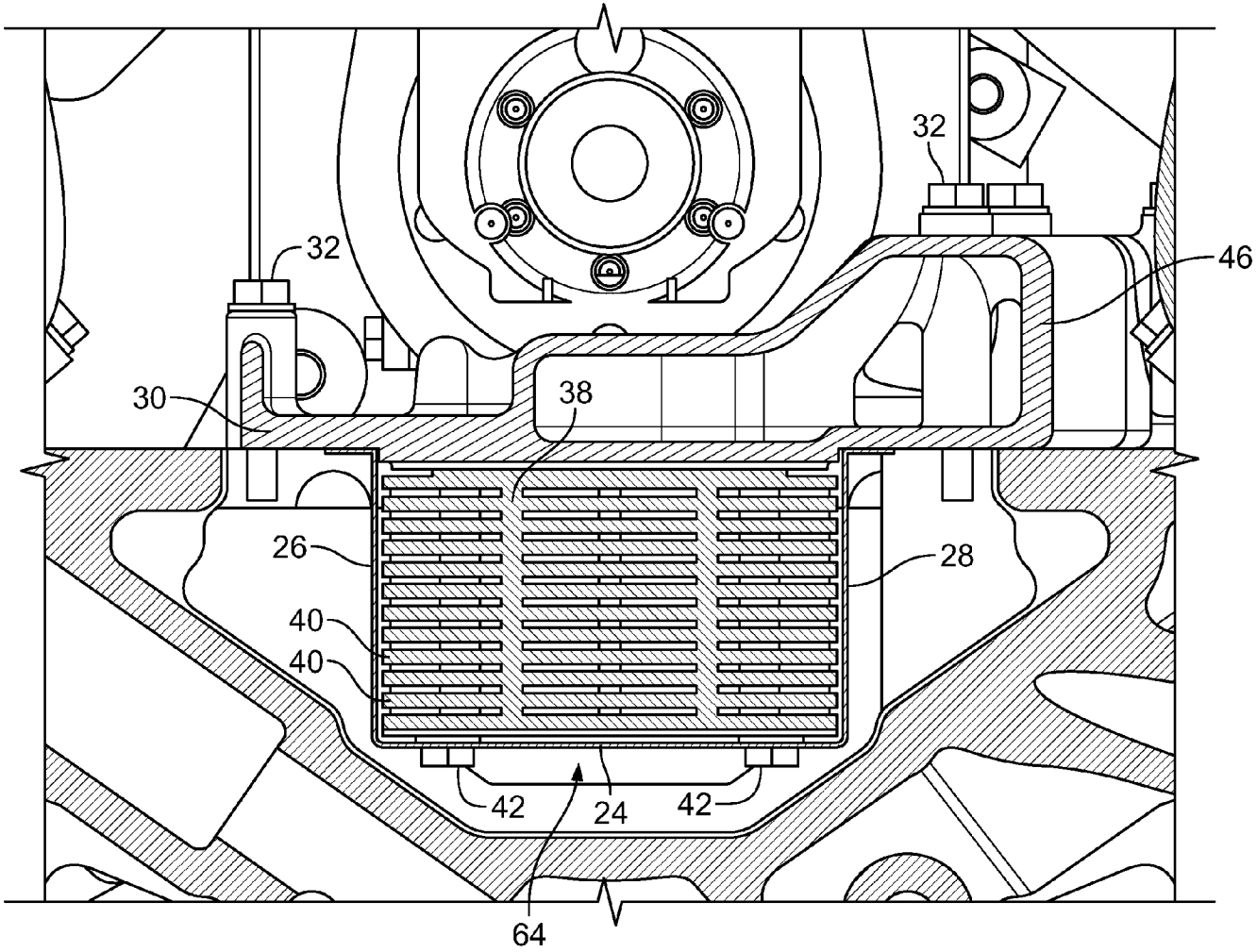
FIG. 5 is a cross-sectional view of the embodiment of FIG. 1 taken along lines 5-5 of FIG. 4.
Figure 6:
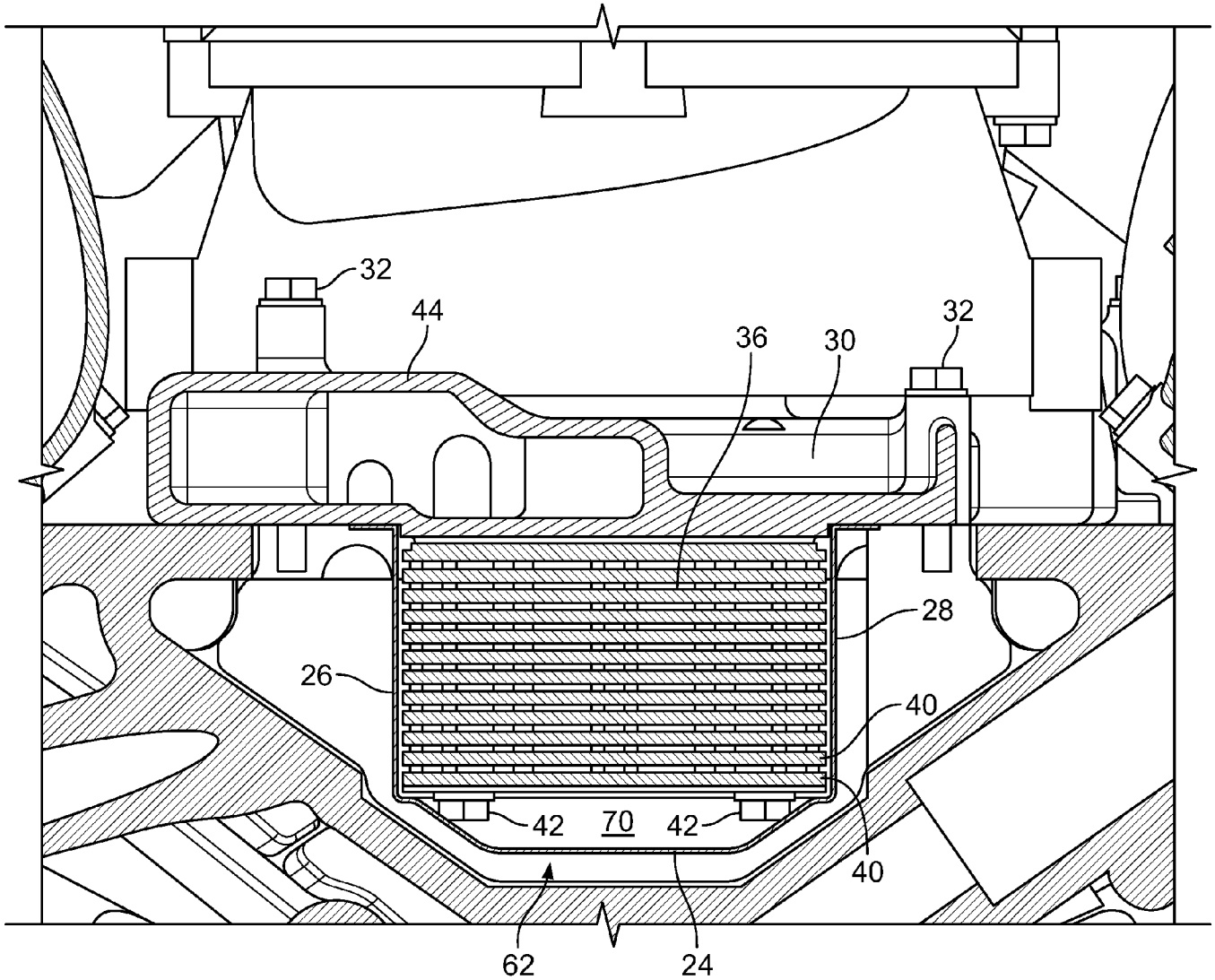
FIG. 6 is a cross-sectional view of the embodiment of FIG. 1 taken along lines 6-6 of FIG. 4.
Figure 7:
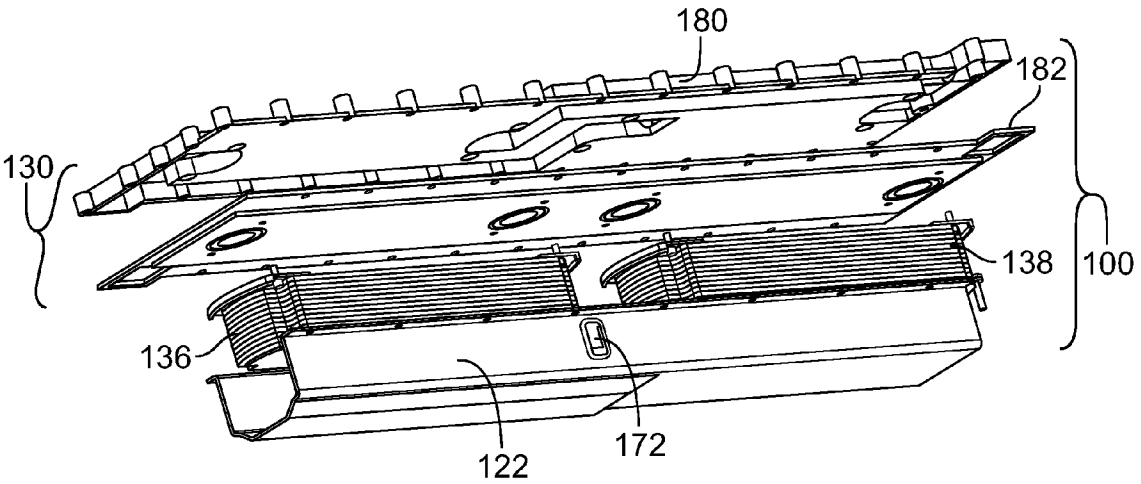
FIG. 7 is an exploded lower perspective view of another embodiment of the current disclosure.
Figure 8:
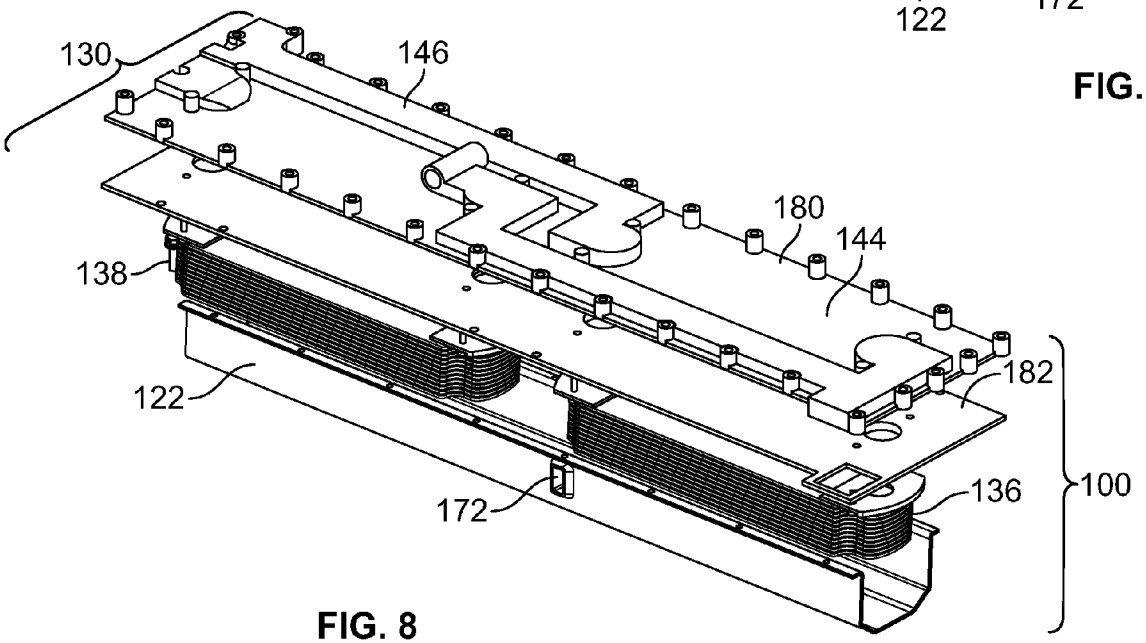
FIG. 8 is an exploded upper perspective view of the embodiment of FIG. 7.
Figure 9:
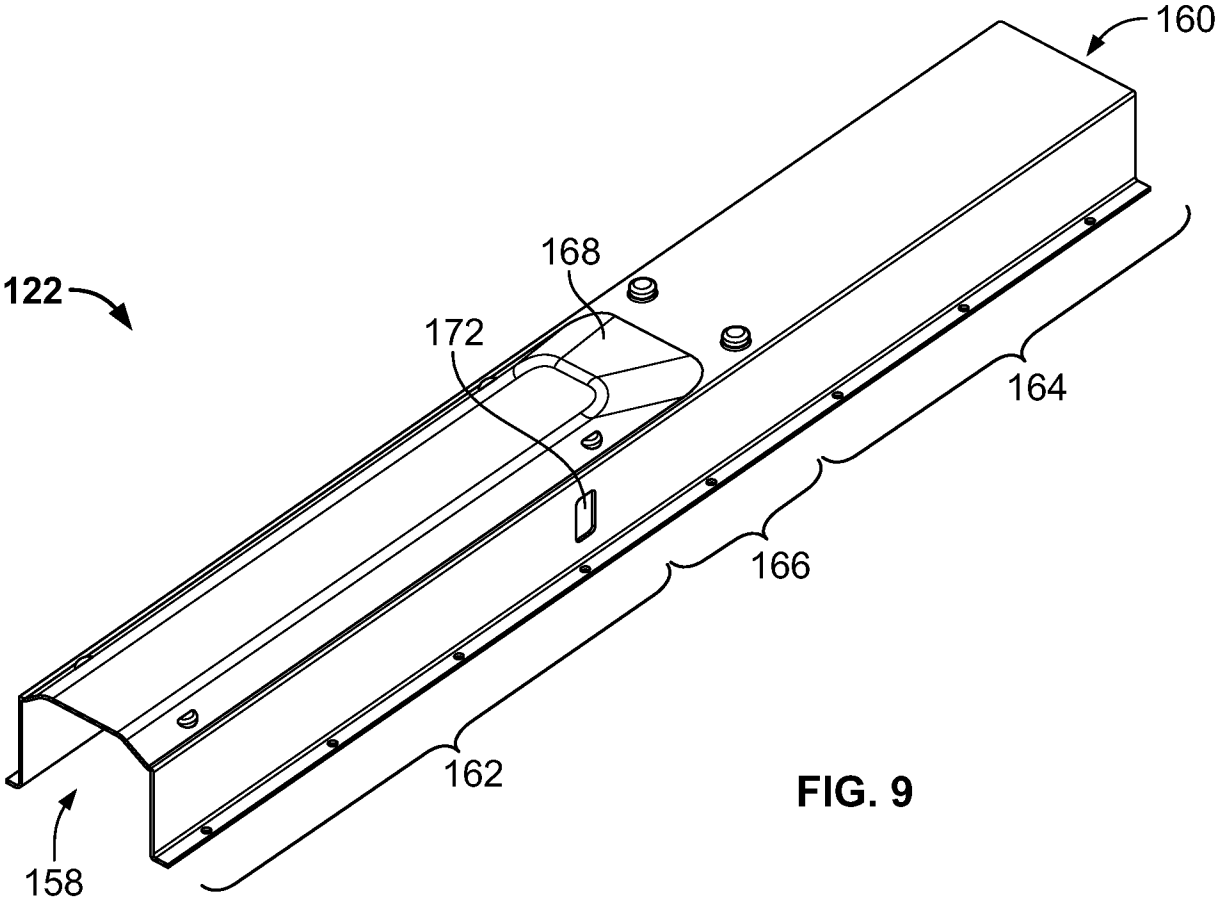
FIG. 9 is a perspective under-side view of the coolant-guide component of the embodiment of FIG. 7.

Referring specifically to FIG. 3, the coolant guide 22 may be designed to provide a distribution of the flow of coolant between the first heat exchanger 36, which is approximate a coolant inlet side 58, and the second heat exchanger 38 which is distal from the coolant inlet side 58 (on an opposite side 60). The bottom wall 24 of the coolant guide may be divided into at least three portions: a first portion 62 proximate to the coolant inlet side 58 and extending substantially the length of the first heat exchanger 36, a second portion 64 proximate to the opposite side 60 and extending substantially the length of the second heat exchanger 38, and an intermediate portion 66 extending between the first portion 62 and the second portion 64. The first portion 62 of the bottom wall 24 may have a first elevation and may be lowered (sunken) with respect to the second portion 64 of the bottom wall 24 to provide a trough or depression 70 (see FIG. 6) below the first heat exchanger 36 when the first heat exchanger 36 is situated within the coolant flow path channel 34.

The second portion 64 of the bottom wall 24 may have a second elevation and may be positioned higher than the first portion 62 and a ramp 68 (or another form of transition) may be provided in the intermediate portion 66 to direct coolant flowing in the trough or depression 70 below the first heat exchanger 36 up into the second heat exchanger 38 positioned in the second portion 64. The side walls 26 and 28 of the coolant guide may include one or more outlet openings 72 that allow heated coolant that has passed through the first heat exchanger 36 to exit out of the side walls 26, 28 before contacting the second heat exchanger 38. Consequently, coolant flowing into the first portion 62 of the coolant guide 22 may be split into at least two portions: an upper portion flowing through the first heat exchanger 36 and a lower portion flowing below the first heat exchanger 36 and into the trough 70 formed by the lowered bottom wall 24in the first portion 62. The upper portion of coolant that passes through the first heat exchanger 36 may be outlet through the outlet slits 72 provided in the side walls 26, 28, while the lower portion of the coolant that passes below the first heat exchanger 36 may be directed up the ramp 68 and into the second heat exchanger 38 so as to flow through second heat exchanger 38 and then to be outlet through the open opposite end 60 of the coolant guide 22.

FIGS. 7-10 provide another embodiment of coolant guide 122 of the engine-fluid cooling assembly. For this embodiment, in the Figures, components corresponding to components from the previous embodiment are similarly numbered, e.g., what was previously cover 30 will be described in this embodiment as cover 130. In the current embodiment of a coolant guide 122, a cover 130 includes a cast top platform component 180 and a steel or aluminum bottom plate 182 enclosing an inlet oil passage 146 and an outlet oil passage 144. Additionally, in the current embodiment, the coolant guide 122 includes a single outlet slit 172 in each side wall. Otherwise, operation and construction of the current embodiment of a coolant guide 122 is essentially similar to that of the previous embodiment of a coolant guide 22.

Figure 11:
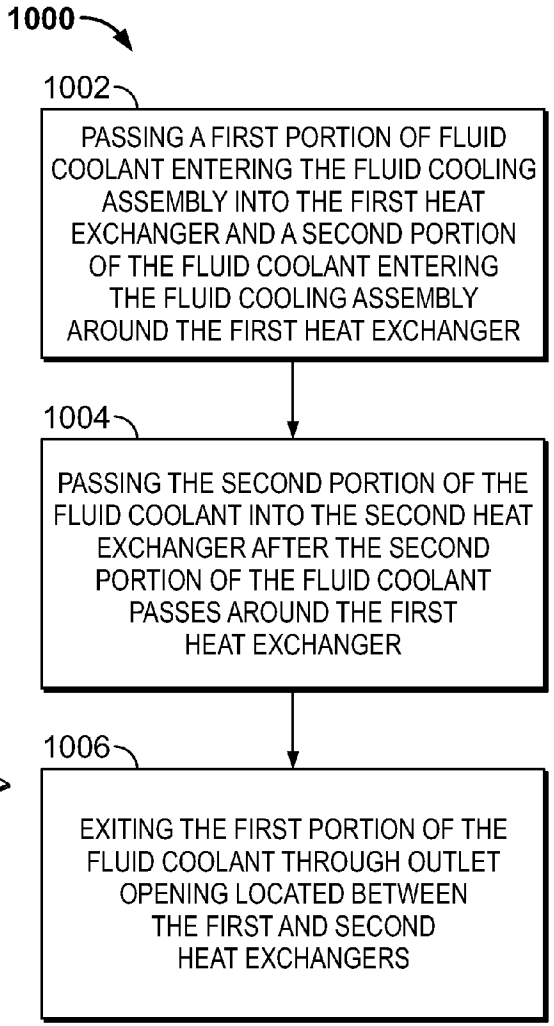
FIG. 11 is a flowchart of an example method of distributing coolant fluid to a pair of heat exchangers.
Figure 10:
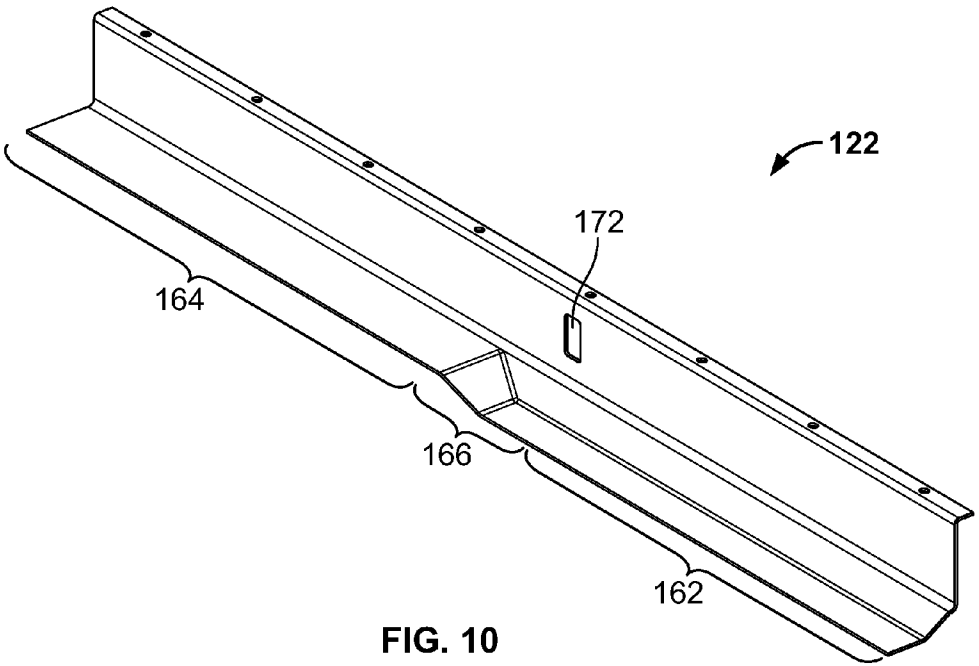
FIG. 10 is a perspective cut-away view of the coolant-guide component of FIG. 7.

FIG. 11 is a flowchart of an example method 1000 of distributing coolant fluid to at least a pair of first and second engine fluid cooling heat exchangers arranged in series in an engine fluid cooling assembly. For the method 1000, the first heat exchanger may be positioned proximate to a fluid coolant inlet of the engine fluid cooling assembly and the second heat exchanger may be positioned distal from the fluid coolant inlet. The method 1000 may comprise operation 1002 which may include passing a first portion of fluid coolant entering the fluid cooling assembly into the first heat exchanger and a second portion of the fluid coolant entering the fluid cooling assembly around, under or in proximity to the first heat exchanger. The method 1000 may also comprise operation 1004 which may include passing the second portion of the fluid coolant into the second heat exchanger after the second portion of the fluid coolant passes around, under or in proximity to the first heat exchanger. The operation 1004 of passing the second portion of the fluid coolant into the second heat exchanger may include passing the second portion of the fluid coolant up into the second heat exchanger. The method 1000 may further include operation 1006 of exiting the first portion of the fluid coolant through outlet openings located between the first and second heat exchangers. Operations 1002 and 1004 may be performed, at least in part, by a baffle having a larger cross-sectional area under or in a region corresponding to the first heat exchanger than under or in another region corresponding to the second heat exchanger, and having a ramp extending between the first and second heat exchangers. For the method 1000, each of the first and second portions of the fluid coolant may individually amount to less than 100% of the total fluid coolant entering the fluid coolant inlet.

Having provided the current disclosure of various embodiments, it will be apparent to those of ordinary skill that the claims shall not be limited to the disclosed embodiments; and that variations can be made without departing from the scope of protection as provided by the ordinary meaning of the claims. For example, and without limitation, it is within the scope of the current disclosure that even though the disclosed embodiments provide a pair of oil coolers disposed in an engine coolant (water/glycol mixture) flow path, there are other possible applications for the coolant assemblies and/or coolant guides disclosed herein. Such alternate applications include, without limitation, fuel cooling, exhaust gas recirculation (EGR) cooling and the like.

INDUSTRIAL APPLICABILITY

The industrial applicability of the engine fluid coolant assembly consistent with the present disclosure will be readily appreciated from the foregoing discussion. Specifically, as discussed previously, there have been observed cooling inefficiencies and uneven fluid cooling in prior art series-type oil cooler configurations in which coolant fluid is provided at one end of the coolant flow path 34 and passes past each heat exchanger in series as they are disposed within the coolant flow path 34. In such a configuration the coolant may be heated by the first heat exchanger in the fluid flow path prior to exposure to and flow through the second heat exchanger along the coolant flow path; and, thus, the efficiently of the second heat exchanger (and any subsequent heat exchangers in the series) may be degraded with respect to the first heat exchanger due to the increased coolant temperature.

The engine fluid coolant assembly of the present disclosure provides a potential solution to this problem by specifically configuring a coolant guide, or baffle, to direct coolant flow over the tandem heat exchangers in a way that a substantial portion the coolant that flows over the first heat exchanger does not substantially flow through the second heat exchanger, and a substantial portion of the coolant entering the coolant guide is directed around the first heat exchanger to the second heat exchanger so that substantially unheated coolant flows to the second heat exchanger.

Another potential benefit to having the heat exchangers arranged as described in the present disclosure is that no individual heat exchanger experiences the entirety of the coolant flow during operation. Typically, once a heat exchanger is saturated, additional coolant flow would provide no additional cooling benefit even as restriction to the coolant would occur. In the present disclosure, the coolant flow is diverted and split between the first and second heat exchangers such that the overall restriction to the system is reduced without losing cooling effectiveness.

Although the engine fluid coolant assembly of the present disclosure has been described in the context of and for use with V-type large internal combustion engines, specifically with those having oil-coolers disposed between cylinder banks of V-type engines, the assembly may be used to improve cooling performance not just for oil coolers but in most situations where heat exchangers are aligned in tandem or series. The improved cooling performance exhibited with the present disclosure also may allow for reduced or smaller components in a coolant assembly package.

What is claimed is:

1. A baffle for engine fluid cooling, comprising:

a fluid coolant guide having a pair of side walls, a bottom wall, a coolant fluid inlet end and a coolant fluid outlet end disposed substantially opposite the coolant fluid inlet end;

wherein the bottom wall includes a first portion with a first elevation extending from the fluid inlet end, a second portion distal from the fluid inlet end and having a second elevation and a transition portion disposed between the first and second portions;

wherein the first elevation is lower than the second elevation, and the transition portion provides a transition from the first elevation to the second elevation;

wherein the side walls and bottom wall provide, at least in part, a channel adapted to receive at least a first engine fluid cooling heat exchanger and a second engine fluid cooling heat exchanger therein so that the first heat exchanger is positioned proximate at least a part of the first portion of the bottom wall and so that the second heat exchanger is positioned proximate at least a part of the second portion of the bottom wall; and wherein at least one of the side walls includes at least one coolant fluid outlet opening positioned between the first and second portions of the bottom wall.

2. The baffle of claim 1, wherein the channel is adapted to receive at least the first and the second heat exchangers therein so that the entire first heat exchanger is positioned above the first portion of the bottom wall and so that the entire second heat exchanger is positioned above the second portion of the bottom wall.

3. The baffle of claim 1, wherein the transition portion of the bottom wall includes a ramp extending from the first portion to the second portion of the bottom wall.

4. The baffle of claim 1, wherein each of the side walls includes a plurality of coolant fluid outlet openings positioned between the first and second portions of the bottom wall.

5. The baffle of claim 1, wherein the coolant fluid inlet end and the coolant fluid outlet end are open ends.

6. An engine fluid cooling assembly for an engine comprising:

a fluid coolant guide including a pair of side walls and a bottom wall, a coolant fluid inlet end and a coolant fluid outlet end, the bottom wall of the fluid coolant guide having a first portion with a first elevation extending from the coolant fluid inlet end, a second portion with a second elevation distal from the coolant fluid inlet end and a transition portion between the first and second portions;

a first engine fluid cooling heat exchanger and a second engine fluid cooling heat exchanger positioned within a fluid coolant channel formed by the side walls and bottom wall of the fluid coolant guide, the first heat exchanger being positioned proximate to at least a part of the first portion of the bottom wall, the second heat exchanger being positioned proximate to at least a part of the second portion of the bottom wall, and the first and second heat exchangers including engine fluid flow paths routed therethrough; and wherein at least one of the side walls of the fluid coolant guide includes at least one coolant fluid outlet opening positioned between the first and second portions of the bottom wall of the fluid coolant guide.

7. The engine fluid cooling assembly of claim 6, further comprising a cover mounted to the side walls of the fluid coolant guide and disposed over the fluid coolant channel, wherein the first and second heat exchangers are mounted to the cover.

8. The engine fluid cooling assembly of claim 7, wherein the cover includes engine fluid flow paths respectively in fluid communication with the engine fluid flow paths of the first and second heat exchangers.

9. The engine fluid cooling assembly of claim 6, wherein the first portion of the bottom wall of the fluid coolant guide extends along the length of the first heat exchanger and the second portion of the bottom wall of the fluid coolant guide extends along the length of the second heat exchanger.

10. The engine fluid cooling assembly of claim 6, wherein the transition portion of the bottom wall of the fluid coolant guide includes a ramp extending from the first portion to the second portion of the bottom wall of the fluid coolant guide.

11. The engine fluid cooling assembly of claim 6 wherein each of the side walls of the fluid coolant guide includes a plurality of coolant fluid outlet openings positioned between the first and second portions of the bottom wall of the fluid coolant guide.

12. The engine fluid cooling assembly of claim 6, wherein the coolant fluid inlet end and the coolant fluid outlet end of the fluid coolant guide are open ends.

13. The engine fluid cooling assembly of claim 6, wherein:

the engine fluid cooling assembly is adapted to cool engine oil; and the first coolant fluid inlet end of the fluid coolant guide is adapted to be supplied with engine coolant.

* * * * *